United States Patent [19]

Cole, Jr. et al.

[11] Patent Number: 4,500,398

[45] Date of Patent: Feb. 19, 1985

[54] PRODUCTION OF LEAD FROM SULFIDES

[75] Inventors: Ernest R. Cole, Jr., Newburg; Agnes Y. Lee; Danton L. Paulson, both of Rolla, all of Mo.

[73] Assignee: The United States of America as represented by the Secretary of the Interior, Washington, D.C.

[21] Appl. No.: 622,515

[22] Filed: Jun. 20, 1984

[51] Int. Cl.[3] ..... C25C 1/18

[52] U.S. Cl. ..... 204/117

[58] Field of Search ..... 204/117; 75/120

[56] References Cited

U.S. PATENT DOCUMENTS 4,149,947 4/1979 Stauter et al. ..... 204/117

*Primary Examiner*—R. L. Andrews

*Attorney, Agent, or Firm*—Thomas Zack; Donald A. Gardiner; E. Philip Koltos

[57] ABSTRACT

Lead is recovered from sulfide ores which contain lead by leaching the ore with fluosilicic acid to form elemental sulfur and lead fluosilicate, and then subjecting the lead fluosilicate to electrolysis to produce lead and fluosilicic acid.

9 Claims, No Drawings

PRODUCTION OF LEAD FROM SULFIDES

FIELD OF THE INVENTION

This invention relates to methods for the recovery of lead from sulfur-containing lead starting materials and, more particularly, to the recovery of lead from sulfur-containing ores and concentrates by a combination leach-electrowinning process that avoids sulfur gases, lead, and other toxic emissions.

BACKGROUND

All of the lead produced in the United States is by pyrometallurgical smelting processes of sulfur-containing ores or feedstocks. The standard methods of obtaining metallic lead from such materials usually include producing concentrates and treating these concentrates in a blast furnace. For example, lead sulfide concentrates containing as much as 75 percent lead are diluted with silica slag to approximately 50 percent lead prior to sintering to produce feed for the blast furnace. During the high temperature sintering process of about 1400° C., substantial and undesirable amounts of lead and sulfur gas emissions occur. The sinter, which consists mainly of lead silicates, is reduced with coke in the lead blast furnace to produce lead bullion, which is an impure lead metal. The blast furnace also contributes significantly to lead and sulfur gas emissions. Fumes collected from the sinter bed and the blast furnace typically will contain 55 percent lead, as well as elements such as arsenic and cadmium, which are also possibly detrimental. A substantial problem with emissions begins in the refinery, where as many as a dozen 250- to 300-ton kettles of lead at temperatures that approach 1,000° C. are in operation at one time. No effective dust or fume collection system exists for such refineries.

Attempts have been made to find a less polluting process for recovery of lead from sulfur-containing materials in view of the recent restrictive environmental standards for lead and sulfur emissions. A prominent process to meet these restrictions is the ferric chloride leach-fused salt electrowinning method. This method avoids lead and sulfur emissions, but the fused salt electrowinning of lead at 500° C. is very demanding of materials used in cell construction and is energy intensive.

The prior art is also aware of other methods for lead recovery from lead-containing materials and recovery of analogous metals from sulfur-containing ores and concentrates. For example, in U.S. Pat. No. 4,149,947 to Stauter et al, metallic lead is obtained from lead-bearing sources, such as lead sulfide ores or concentrates by halogenating the lead source, brine leaching the lead halide to separate the soluble lead halide from solid materials, and recrystallizing the lead halide at a reduced temperature. The lead halide is then converted to lead carbonate by treatment with carbon dioxide, solubilized in hydrofluosilicic acid, and subjected to electrolysis to produce pure lead. In other procedures, U.S. Pat. No. 3,959,436 to Watts describes an oxidative leaching process for leaching metal sulfide minerals. This process comprises leaching a metal sulfide mineral by contacting the mineral with an oxidated leaching solution to recover the metals, which includes the steps of adding an aqueous solution of hydrogen peroxide to the oxidated leaching solution. In U.S. Pat. No. 4,011,146 to Coltrinari et al, metal values are recovered from sulfide ores which contain lead, zinc, and silver sulfides by converting the sulfides to chlorides by chlorination, followed by solubilization with a sodium chloride leach, and subsequent recovery of the metals from their chlorides by a conventional process, which can include fused salt electrolysis. In U.S. Pat. No. 4,440,569 to Weir et al, zinc is recovered from zinc-containing sulfide ores by leaching the sulfide ore under oxidizing conditions in excess sulfuric acid. The undissolved residue which contains the lead and/or silver is then separated and treated to recover the lead values.

There remains a need in the art, however, for a process for the recovery of lead and equivalent metals from sulfur-containing materials which are not subject to the disadvantages of the polluting and energy-intensive processes known to the art.

SUMMARY OF THE INVENTION

It is, accordingly, one object of the present invention to provide a non-polluting method for the recovery of lead from ores and concentrates containing lead and sulfur.

A further object of the present invention is to provide a method for the recovery of lead and equivalent metals from sulfide and metal-bearing materials involving a combination of a leaching process and an electrowinning procedure.

A still further object of the present invention is to provide a method for the recovery of lead from sulfur ores which contain lead by a substantially non-polluting process involving a first leaching step, followed by an electrowinning step, to produce pure lead.

Other objects and advantages of the present invention will become apparent as the description thereof proceeds.

In satisfaction of the foregoing objects and advantages, there is provided by this invention a method for the recovery of lead from sulfur-containing materials which also contain lead, which comprises the steps of: (a) reacting the sulfur-containing lead material with a fluosilicic acid solution in the presence of an oxidizing agent to produce a solution containing lead fluosilicate, and (b) subjecting the lead fluosilicate to an electrowinning step to produce lead and fluosilicic acid.

DESCRIPTION OF PREFERRED EMBODIMENTS

As pointed out above, the present invention is concerned with methods for the recovery of lead from sulfur-containing ores and concentrates or waste materials. While the process is primarily useful for the recovery of lead from sulfur-containing ores, it is similarly operable for the recovery of zinc, copper, and tin from sulfur-containing ores which contain these metals. Therefore, while the invention is described with respect to the recovery of lead, it is to be understood that the process is also inclusive of the recovery of equivalent metals from sulfur-containing ores.

The present invention is based on the use of two significant process steps to recover pure lead from starting materials which contain sulfur and which also contain lead. Starting materials of this type primarily include sulfide ores, sulfide concentrates, waste matters containing both lead and sulfides, or any other source which contains combinations of lead and sulfur, as well as other materials.

The present invention demonstrates that a two-step procedure can be carried out using moderate reaction conditions and in the substantial absence of pollution to produce free and pure lead from ores and concentrates or the like which contain lead and sulfur. The two steps include a first leaching step with fluosilicic acid in the presence of an oxidizing agent, followed by an electrowinning step of a resulting lead fluosilicate solution, to produce the pure lead and fluosilicic acid.

The combination method of the present invention has several advantages over current practice. First, the fluosilicic acid-oxidizing leach step extracts the lead as lead fluosilicate, while at the same time producing elemental sulfur. Thus, both lead emissions and sulfur oxide fumes are avoided. This should provide a process which will meet current and proposed standards for lead and sulfur oxide emissions, as proposed by the Environmental Protection Agency and OSHA. Further, what sulfur is recovered in the present pyrometallurgical smelting of lead is recovered as sulfuric acid. The recovery of sulfur as elemental sulfur, as in this process, rather than sulfuric acid, as in the prior art, is a substantial advantage because elemental sulfur can be more easily stored and shipped and can be readily converted to sulfuric acid as the need arises.

Secondly, electrowinning at ambient or slightly higher temperatures to recover a pure lead product has a distinct advantage over the current high temperature (1200° to 1400° C.) pyrometallurgical smelting processes of the prior art in that, in the present invention, there are no lead, sulfur, or other emissions. The method of this invention also has the advantage over the fused salt process conducted at about 500° C. in that no special materials are necessary for cell construction, and ambient temperature electrowinning is less energy intensive. A further advantage used is that the fluosilicic acid which is used as the electrolyte in the electrowinning step is an inexpensive waste product readily available from phosphoric acid plants.

The method of the invention comprises two basic steps. In the first step, the sulfide ore which contains the lead is leached in a fluosilicic acid solution which contains a suitable oxidant, such as hydrogen peroxide or lead dioxide ($PbO_2$). This reaction produces a solution of lead fluosilicate and a residue containing elemental sulfur. In this reaction, the lead oxide (PbO) formed in the process will react with additional fluosilicic acid. The reactions occurring in this first step are as follows:

$$2PbS + 2H_2SiF_6 + H_2O_2 + PbO_2 \rightarrow 2PbSiF_6 + 3H_2O + 2S^o + PbO \quad (1)$$

$$PbO + H_2SiF_6 \rightarrow PbSiF_6 + H_2O \quad (1a)$$

From the above equations, it will be noted that the total final products are actually lead fluosilicate, water, and elemental sulfur. The water solution containing the metal fluosilicate is then subjected in the second major step of the invention to an electrowinning procedure at ambient or slightly higher temperatures to produce lead and fluosilicic acid. This reaction occurs according to the following equation:

$$PbSiF_6 + 2H^+ + 2e^- \rightarrow Pb^o + H_2SiF_6 \quad (2)$$

As is apparent from the above two reactions, the process of this invention provides a direct, low-temperature (less than 100° C.) route from sulfide starting materials to produce the pure metal without the usual emissions attendant to present high-temperature smelting processes. The further distinct advantage is that the sulfur is recovered as elemental sulfur instead of sulfuric acid. Elemental sulfur is easier to store and ship and can be readily converted to sulfuric acid as necessary.

In the initial step of the invention comprising leaching of the sulfide ore or concentrate, it is preferred that the fluosilicic acid be a waste material obtained, for example, from a phosphate fertilizer manufacturing plant. Many forms of phosphate rock, including apatite, contain about 3 to 4 weight percent of fluorine in the rock or ore, which is subsequently converted to fluosilicic acid and can be recovered from such plants. It is generally a waste material and readily available inexpensively. A further advantage is that the waste acid will control $PbO_2$ formation at the anodes during the electrowinning step. In the leaching step, the concentrate should be ground or crushed to a small particle size, for example, less than about −100 mesh, and can be added to a solution of the fluosilicic acid, preferably with agitation. The oxidizing agents may then be added in amounts of about 0.5 percent up to a total of about 5 weight percent of oxidizing agents, based on the amount of sulfide ore being treated. The oxidizing agent may be any oxidizing agent sufficient to cause the reaction to occur but, preferably, is a combination of lead dioxide powder and hydrogen peroxide as an aqueous solution. As pointed out above, the lead dioxide is reduced during the process to lead oxide, which can then react with additional fluosilicic acid.

In the highly preferred procedures, it has been found that a portion of the oxidizing agent is initially added to the fluosilicic acid, followed by the addition of the sulfide concentrates, so that the possible emission of hydrogen sulfide gas is avoided. Accordingly, this represents a preferred procedure for the invention.

After the sulfide ore has been added to the fluosilicic acid, with stirring, the temperature of the mixture is then increased to range from about 50° to 100° C., preferably about 75° to 90° C., and the remainder of the oxidizing agent is added slowly to maintain the temperature in the range of 88° to 90° C. At this point, the oxidation reduction potential of the reaction should be maintained between about 480 to 600 millivolts by controlling the rate of addition of the oxidizing agents, hydrogen peroxide, and lead dioxide. Once the oxidation reduction potential remains about 480 millivolts with no further additions of oxidizing agents, the leaching is complete. This usually requires 1 to 2 hours, but this will obviously depend on the quantity of material being leached.

On completion of the leaching reaction, solids comprising the elemental sulfur are separated from the solution, from which it will be found that the leached solution contains lead fluosilicate and free fluosilicic acid. This solution is then suitable for the recovery of pure lead by the electrowinning step.

The leach solutions preferably will contain about 80 to 290 grams per liter of lead as lead fluosilicate and about 50 to 130 grams per liter of free fluosilicic acid, depending, of course, on the amounts of starting materials used. Lead extraction efficiencies of 90 to 100 percent can be consistently obtained when the following range of leaching solutions are used:

| | |
|---|---|
| Pb concentrate, weight | 10 to 30 g |
| 100 ml $H_2SiF_6$, concentration | 150 to 300 g/l |
| $H_2O_2$ (30–35 percent), volume | 5, 7.5, 10, or 20 ml |

-continued

| | |
|---|---|
| | in combination with |
| $PbO_2$ (tech. powder), weight | 10, 8, 6, or 0 g |
| Leaching temperature | 85 to 92° C. |
| Leaching time | 1 to 2 hours. |

It will be noted that, as the amount of hydrogen peroxide increases, the amount of lead dioxide required decreases. The reaction works well with hydrogen peroxide and without lead dioxide, but the reverse is not true. Some hydrogen peroxide is necessary, regardless of the amount of lead dioxide used.

At this stage, the lead fluosilicate solution recovered from the first stage is subjected to an electrowinning step, by which the lead is recovered through electrolysis. The procedure for conducting the electrowinning step is generally as set forth in U.S. Pat. No. 4,272,340 of Cole et al, and the disclosure with respect to the electrowinning step from that patent is hereby incorporated herein by reference. In conducting the electrolysis step, the cathode is preferably a lead sheet of high purity. In the experiments of this application, the lead cathode was a 0.01 centimeter thick lead sheet of 99.9 percent purity. The cathode was about 5 centimeters wide by 12 centimeters long. In this electrowinning step, two anodes were used which were special lead dioxide coated titanium anodes, which are described, for example, by Smith et al in U.S. Pat. No. 4,159,231.

In conducting the electrolysis, a container is provided which should be filled with the lead fluosilicate-fluosilicic acid solution obtained from the first stage. The lead cathode and anodes should be inserted and leads from the power supply attached. On provision of the desired current setting, the lead will be deposited at the lead cathode. On completion of the electrolysis, the cathode containing the deposited lead is washed and dried and then may be melted and cast. The lead dioxide-coated anodes can be washed and dried for reuse.

Operating parameters for the electrowinning step will include cell temperatures in the range of about 20° to 30° C., preferably ambient temperature, current densities in the range of about 150 to 250 $A/m^2$, and solution concentrations ranging from about 50 to 200 grams per liter of the lead and fluosilicic acid components. There may be also added to the solution additives which will provide for grain refinement and leveling, such as, for example, calcium lignin sulfonate and bone gelatin. These materials should be added in minor amounts, for example, about 0.01 to 0.1 grams per liter, for the leveling agent, and about 2 to 10 grams per liter for the grain refining agent. It is also usually desirable to add a small amount of phosphoric acid, for example, about 0.5 to 2 grams per liter, to control the lead dioxide formation at the anodes during the electrolysis. Preferred operating parameters for the electrolysis are as follows:

| | |
|---|---|
| Solution concentration | 100 g/l Pb, 90 g/l free $H_2SiF_6$ acid, 0.05 g/l bone gelatin, and 4.0 g/l calcium lignin sulfonate |
| Current density | 180 $A/m^2$ |
| Cell temperature | Ambient |
| Time | 72 hours |
| Electrode spacings | 3 cm |
| Number of anodes | 2 |
| Number of cathodes | 1 |

In conducting these experiments, the maximum deposition time for the experiments conducted was about 72 hours. However, in a commercial operation, the cycle time would be a minimum of about 5 days.

The chemical purity of the lead produced from the electrolysis step was about 99.99+ percent. The current efficiency is near 96 percent, based on the experiments conducted, at 180 $A/m^2$. Excellent cathode deposits were obtained, and energy consumption was less than 0.7 kwhr/kg of the lead electrowon from the system.

The following experiments are presented to illustrate the invention, but it is not to be considered as limited thereto. In the experiments and throughout the specification, parts are by weight unless otherwise indicated.

In the following experiments, lead sulfate concentrates from a Missouri lead smelter, reagent-grade chemicals from a chemical supply house, and waste fluosilicic acid ($H_2SiF_6$) from a phosphate fertilizer manufacturing plant were used in all the experiments. The phosphorus in the waste acid controls $PbO_2$ formation at the anodes during the electrowinning step. All leaching tests were conducted in 250 to 2000 milliliter glass beakers. A platinum electrode and a silver chloride reference were used to measure the oxidation reduction potential.

The two anodes used were 0.5 centimeters thick, 4 centimeters wide, by 12 centimeters high. They were $PbO_2$ coated titanium anodes, as described in U.S. Pat. No. 4,159,231. The cathode used for electrowinning was made from a 0.1 centimeter thick lead sheet, which was 99.9 percent pure and which was cut to a size of 5 centimeters by 12 centimeters in length.

A 0.3 centimeter thick Teflon cover was used to hold and space the electrodes and to retard solution evaporation during electrowinning in the 2-liter plastic cell. The cover had a 0.1 centimeter slot cut so that the lead cathode could be slid in from the edge and centered in the cell. Precisely 3 centimeters on each side of the center slot and parallel to it, 2 openings were cut about 0.7 centimeters by 4 centimeters for inserting the anodes. An oval-shaped copper bus bar was placed on top of the cover to support the two anodes and maintain the desired 3-centimeter electrode spacing. The copper bus bar also served as the electrical connection. Other equipment for the electrowinning step included the 40 v to 50 v power supply, a voltage recorder, and an amp/hr meter.

The lead sulfide concentrates used in the experiments were obtained from a Missouri lead smelter and partial analyses of 2 samples obtained at different times are set forth below in the following table:

TABLE 1

Partial Analysis of PbS Concentrates (Minus 400-mesh), weight percent

| Element | Sample 1 | Sample 2 | Element | Sample 1 | Sample 2 |
|---|---|---|---|---|---|
| Pb | 73.05 | 71.16 | Ni | NA | 0.04 |
| S | 13.80 | 12.75 | Co | NA | .03 |
| Zn | 4.10 | 2.04 | Sb | NA | .03 |
| Fe | .66 | 1.05 | Sn | NA | <.07 |
| Cu | .16 | .41 | Al | NA | .08 |
| As | <.05 | .005 | Ca | NA | NA |
| Ag | <.01 | <.01 | Mg | NA | NA |

In the first stage, or leaching step, the typical leaching procedure included the use of 20 grams of −400 mesh PbS concentrate, 0.5 grams $PbO_2$ powder, and 2 milliliters $H_2O_2$ (30 percent). These materials were added to 100 milliliters of fluosilicic acid contained in a 250-milliliter tall beaker prior to adding any lead sulfide.

After the lead sulfide had been added, the temperature of the mixture was increased to 80° C., with stirring, and the remainder of the hydrogen peroxide and lead dioxide was added slowly to maintain the temperature of the mixture at 88° to 90° C. The oxidation reduction potential was maintained between 480 to 600 millivolts by controlling the rate of the hydrogen peroxide and lead dioxide additions. Once the oxidation reduction potential remained about 480 millivolts, without further additions of oxidizing agents, the leach was considered complete. For the quantities used in the experiments, this usually required about 90 minutes. After solid-liquid separation, the resulting leach solution contained lead fluosilicate and free fluosilicic acid, the solution being suitable for recovering the lead metal by electrowinning.

EXAMPLE 1

Twenty grams of lead sulfide concentrate were leached in 100 milliliters of fluosilicic acid solution which contained 250 grams/liter of $H_2SiF_6$. The solution contained 7.5 milliliters of 30 percent hydrogen peroxide and 8.75 grams of lead dioxide. The solution was maintained at 90° C. for 1.5 hours. On completion of the leaching and filtering, the resulting leachate comprising 116 milliliters contained 190 grams/liter of lead and 90 grams/liter of free $H_2SiF_6$. The residue, which weighed 5.6 grams, contained 45 percent of elemental sulfur This represented a 98 percent lead recovery from the leaching step.

EXAMPLE 2

In a second experiment, 200 grams of lead sulfide concentrate was leached in a 2-liter beaker containing 1 liter of fluosilicic acid solution which contained 236 grams/liter of fluosilicic acid, 50 milliliters of 30 percent hydrogen peroxide, and 98.5 grams of lead dioxide. The reaction was conducted at 90° C. for 2 hours. The resulting leachate totalled 1.2 liters and contained 188 grams/liter of lead and 65 grams/liter of free, fluosilicic acid.

Prior to subjecting the solution to the electrowinning step, the concentrations of the lead and free acid in the leachate were adjusted by adding water and fluosilicic acid to obtain desired concentrations of 100 grams/liter of lead and 90 grams/liter of fluosilicic acid. Four grams/liter of calcium lignin sulfonate and 0.05 grams/-liter of bone gelatin were added for grain refinement and leveling, respectively. One gram/liter of phosphorus as phosphoric acid was added to control lead dioxide formation at the anodes during electrowinning.

After these additions were completed, the solution was subjected to electrolysis in a 2-liter cell using two lead dioxide-coated titanium anodes and a pure lead cathode. The electrolysis conditions included a current density of 180 $A/m^2$, electrode spacing of 3 centimeters, and a cell temperature at ambient, with a time of 72 hours. As a result of the electrolysis step, a lead deposit analyzing 99.998+ percent lead was obtained, which had a 96 percent current efficiency.

EXAMPLE 3

After the solid-liquid separation step from the leaching procedure in Example 2, the residue was washed with water and then analyzed to determine the components. The analysis was as follows:

TABLE 2

| Analysis of Leach Residue, weight percent | | | |
|---|---|---|---|
| Element | Percent | Element | Percent |
| Pb | 24.7 | Co | 0.08 |
| S | 45.2 | Sb | 0.08 |
| Zn | 5.22 | Sn | <0.07 |
| Fe | 1.53 | Al | <0.03 |
| Cu | .50 | As | <0.05 |
| Ni | .10 | Ag | 0.03 |

From the above table, it will be noted that the residue contained all the sulfur that was originally present in the lead concentrate as elemental sulfur. In addition, the mixture contained some lead sulfate and small amounts of sulfides of silver, aluminum, cobalt, copper, iron, nickel, lead, antimony, and tin.

The invention has been described herein with reference to certain preferred embodiments. However, as obvious variations thereon will become apparent to those skilled in the art, the invention is not to be considered as limited thereto.

What is claimed is:

1. A method for the recovery of lead from sources of lead which also contain sulfur, which comprises the steps of:

(a) reacting the sulfur-containing lead source with a fluosilicic acid solution in the presence of an oxidizing agent to produce a solution containing lead fluosilicate and a residue containing elemental sulfur; and (b) subjecting the lead fluosilicate solution to electrolysis to produce lead and fluosilicic acid.

2. A method according to claim 1 wherein the lead source is a lead sulfide ore, a lead sulfide concentrate, or a lead sulfide waste material.

3. A method according to claim 2 wherein the. oxidizing agent comprises hydrogen peroxide and lead dioxide.

4. A method according to claim 3 wherein at least a portion of the oxidizing agent is added to the fluosilicic acid prior to addition of the lead sulfide source.

5. A method according to claim 4 wherein the oxidizing agent and lead sulfide source material are added to the fluosilicic acid at a rate to maintain the temperature of about 80° C. to 90° C.

6. A method according to claim 5 wherein the oxidizing agents are added to the fluosilicic acid at the rate to maintain the oxidation reduction potential between about 480 to 600 millivolts.

7. A method according to claim 1 wherein the fluosilicic acid is subjected to electrolysis at a solution concentration of about 50 to 200 grams/liter of lead and about 50 to 200 grams/liter of free fluosilicic acid.

8. A method according to claim 7 wherein the electrolysis cell contains at least 1 anode which is a lead dioxide-coated titanium anode.

9. A method according to claim 8 wherein the cathode in the cell is a pure lead cathode. -

* * * * *